United States Patent [19]

Faucz

[11] 4,346,156

[45] Aug. 24, 1982

[54] ELECTROPHOTOGRAPHIC-MAGNETIC DUPLEX IMAGING STRUCTURE AND METHOD

[75] Inventor: Eugene C. Faucz, Webster, N.Y.

[73] Assignee: Xerox Corporation, Stamford, Conn.

[21] Appl. No.: 726,853

[22] Filed: Sep. 27, 1976

Related U.S. Application Data

[63] Continuation-in-part of Ser. No. 672,809, Apr. 1, 1976, abandoned.

[51] Int. Cl.[3] ..... G03G 19/00

[52] U.S. Cl. ..... 130/39; 430/57; 430/79; 430/122; 430/130; 250/317.1; 346/74.2; 360/59

[58] Field of Search ..... 96/1.5, 1 R; 355/3; 360/55, 56, 59; 427/18; 346/74 MP, 74.2; 430/39, 57, 79, 122, 130; 250/317, 318, 317.1

[56] References Cited

U.S. PATENT DOCUMENTS

| | | | |
|---|---|---|---|
| 2,939,787 | 6/1960 | Giaimo | 96/1.5 |
| 3,313,626 | 4/1967 | Whitney | 96/1.5 |
| 3,485,621 | 12/1969 | Kazan | 96/1 R |
| 3,520,811 | 7/1970 | Swoboda | 96/1.5 |
| 3,558,492 | 1/1971 | Proskow | 96/1.5 X |
| 3,804,511 | 4/1974 | Rait et al. | 427/18 |
| 3,815,987 | 6/1974 | Duck et al. | 96/1 R |
| 3,815,987 | 6/1974 | Duck et al. | 96/1 R |

FOREIGN PATENT DOCUMENTS

| | | | |
|---|---|---|---|
| 902479 | 9/1962 | United Kingdom | 96/1.5 |
| 902480 | 9/1962 | United Kingdom | 96/1.5 |

*Primary Examiner*—John E. Kittle
*Assistant Examiner*—John L. Goodrow

[57] ABSTRACT

An electrophotographic magnetic imaging member comprises a conductive, magnetizable layer in contact with a photoconductive layer. An electrostatic latent image is formed on the photoconductive layer utilizing the conductive, magnetizable layer as a conductive electrode in carrying out the electrophotographic discharge step. The conductive, magnetizable layer is also magnetized with a selected spatial wavelength of magnetic transitions. The electrostatic latent image is developed with toner which reflects or absorbs visible electromagnetic radiation. The imaging member is exposed to visible electromagnetic radiation from the photoconductive side. In one embodiment, the visible radiation is absorbed or reflected by the toned image and is transmitted through uncovered portions of the photoconductor, heating the conductive, magnetizable layer and thermoremanently erasing magnetic transitions in the magnetizable layer. In another embodiment, the visible radiation is absorbed by a thin photoconductive layer in uncovered portions of the photoconductor, which uncovered portions transport the absorbed heat to the conductive, magnetizable layer which thermoremanently erases magnetic transition in the magnetizable layer. The magnetizable layer in both embodiments is thereby provided with a magnetic latent image corresponding to the electrostatic latent image.

9 Claims, 5 Drawing Figures

ELECTROPHOTOGRAPHIC-MAGNETIC DUPLEX IMAGING STRUCTURE AND METHOD

CROSS REFERENCE TO RELATED APPLICATION

This application is a continuation-in-part of U.S. Application Ser. No. 672,809, filed Apr. 1, 1976, now abandoned.

BACKGROUND OF THE INVENTION

This invention relates to to magnetic imaging and more particularly, to structure and method for creating a latent image on a magnetizable member.

There has recently been introduced a magnetic imaging system which employs a latent magnetic image on a magnetizable member which can then be utilized for purposes such as electronic transmission or in a duplicating process by repetitive magnetic toning and transfer of the developed magnetic latent image. Such latent image is provided by any suitable magnetization procedure whereby a magnetized layer of marking materials is magnetized, such magnetism transferred imagewise to a magnetic substrate. Such a process is more fully described in U.S. Pat. No. 3,804,511 to Rait et al. Such a process requires the utilization of an original image, creating a duplicate of the original image in magnetizable marking material, magnetizing the magnetizable marking material, and then transferring the signal from the magnetized marking material to a magnetizable member. For example, an original document to be copied is electrostatically latently imaged onto a photoconductor and the latent image developed with electroscopic particles containing magnetizable material. The developed image is then magnetized and the magnetic signal of the magnetized, developed image is transferred to a magnetizable member.

A composite imaging member which can be utilized is described in Application Ser. No. UM45-70294, filed in Japan July 14, 1970 and published on Sept. 18, 1974 as publication no. UM74-34369. The magnetic recording medium disclosed therein comprises a plastic base, a magnetic recording layer on the surface of the base, a protective film containing an antistic agent or an electroconductive material formed on the magnetic recording layer, and an electrophotographic layer provided on the backside of the base through an electroconductive ground layer.

The present invention provides an improved composite magnetic recording medium comprising a photoconductive layer in contact with a conductive, magnetizable layer. The conductive, magnetizable layer performing the function of both conductive electrode and a recording medium

SUMMARY OF THE INVENTION

Therefore, an object of this invention is to provide a simplified composite magnetic recording medium.

Another object of this invention is to provide a reusable composite magnetic recording medium.

A further object of this invention is to provide an imaging method utilizing the simplified magnetic recording medium in which fusing of the electroscopic toner to the photoconductor is eliminated.

Another object of the present invention is to eliminate the need for developing the electrostatic latent image with developing material comprising a magnetic material.

A further object of the present invention is to eliminate the need of transferring developing material from the photoconductor in the creation of a magnetic latent image.

These and other objects are provided in accordance with the present invention by providing a magnetic recording medium comprising a photoconductive layer substantially transmissive to visible radiation in contact with a conductive, magnetizable layer. The photoconductive layer is electrostatically latently imaged and developed with toner which reflects or absorbs visible radiation. The conductive magnetizable layer is magnetically recorded and serves as an electrode in the electrophotographic discharge step. The imaging member is exposed to visible radiation from the photoconductive side, the reflective toner shielding portions of the magnetizable layer from the visible radiation. Remaining portions of the magnetizable layer which are not shielded from thermal radiation are erased by being heated to the Curie point of the magnetic materials therein. A magnetic latent image is thereby created corresponding to the electrostatic latent image.

DETAILED DESCRIPTION OF THE PREFERRED EMBODIMENTS

Figure 1:
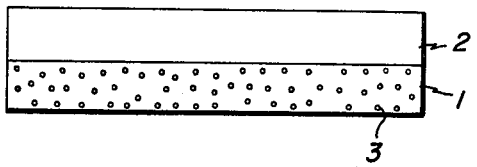
FIG. 1 is a schematic illustration of the simplified, composite magnetic recording medium in accordance with the practice of the present invention.

Referring now to FIG. 1 there is schematically illustrated a composite magnetic recording medium is accordance with the present invention. Photoconductive layer 2 resides on conductive, magnetizable layer 1.

In one embodiment, wherein the visible radiation passes through the photoconductor and is absorbed principally in the magnetic medium, photoconductive layer 2 can comprise any photoconductor substantially transparent to visible electromagnetic radiation. By the phrase "visible electromagnetic radiation" is meant electromagnetic radiation having a wavelength of from about 2900 Å to about 38,000 Å. Typical suitable photoconductive material for use in photoconductive layer 2 include inorganic and organic photoconductive materials. Typical suitable inorganic materials include crystalline selenium, amorphous selenium; amorphous selenium alloyed with arsenic, tellurium, antimony, bismuth, etc., amorphous selenium or its alloys doped with halogens; tellurium and mixtures of amorphous selenium and one or more crystalline forms of selenium including the monoclinic and hexagonal forms. Any other inorganic material can be utilized in the practice of the present invention, provided the layer is sufficiently thin to be transparent or transmissive to visible radiation. In this regard, it has been found that selenium layers of from about 0.1 micron to about 0.25 microns are preferred because above about 0.25 microns the absorption of vibible radiation by the photoconductive layer begins to appreciably diminish the amount of thermal energy reaching the conductive, magnetizable layer 1. Photoconductive layer 2 of inorganic photoconductive materials outside the range of about 0.1 micron to about 0.25 micron can be employed but it will be appreciated that the amount of visible electromagnetic radiation needed to thermoremanently erase the conductive, magnetizable layer 1 is thereby increased.

Any organic photoconductive material which is transparent or transmissive to visible electromagnetic radiation can be employed as the photoconductive material for photoconductive layer 2. Organic photoconductive materials include, for example, the combination of 2,5-bis(p,aminophenyl)-1, 3,4-oxadiazole available under the trademark TO 1920 from Kalle and Co., Weisbaden-Biebrich, Germany and Vinylite VYNS, a copolymer of vinyl chloride and vinyl acetate, available from Carbide and Carbon Chemicals Co.; and the combination of 2,4,7-trinitro-9-fluorenone to polyvinylcarbazole, available under the trademark Luvican 170 from Winter, Wolf and Company, New York, N.Y. The thickness of photoconductive layer 2 when made of organic photoconductive material which is transparent or transmissive to visible electromagnetic radiation is not critical. A particularly preferred organic photoconductor comprises a mixture of triphenylamine and Lexan, the trademark for a thermoplastic carbonate-linked polymer produced by reacting bisphenol A and phosgene. This mixture of organic materials is particularly preferred because of its high degree of clarity and transmissivity to visible electromagnetic radiation. That is, there is a minimum amount of absorption of thermal energy from the visible radiation by this mixture.

In the second embodiment of the invention, any highly absorbing photoconductor which can be applied as a very thin layer, which can absorb the visible radiation and transport the resulting heat into the magnetic recording medium can be employed.

By "very thin" is meant a thickness for the particular opaque photoconductive selected which does not laterally transport substantial amounts of absorbed heat compared to its conduction of absorbed heat through its thickness. This is desired to preferably eliminate and at least minimize thermal undercutting of the toner image by which erasure of the magnetic medium can occur in undesired regions.

Layers of sputtered cadmium sulfide having a thickness of about 3000 Å and heavily dye-sensitized polyvinylcarbazole layers of about three microns in thickness are illustrative examples of absorbing photoconductors. Another example of an absorbing photoconductor suitable for use in the second embodiment is a double layer photoreceptor having a thin "sensitizing" layer such as amoprhous selenium or organic pigments highly absorbent of visible light, coated over a relatively thick transparent photoconductor such as polyvinylcarbazole or trinitrofluorenone. Charge carriers are photogenerated in the sensitizing layers and injected into and transported across the photoconductive layer. The light absorbing sensitizing layer is placed in contact with the magnetizable layer.

In the second embodiment of the invention, it will be appreciated that owing to the thinness of the photoconductor the electrophotographic magnetic imaging member of the present invention can be magnetized from the photoconductor side. That is, the recording head 7 of FIG. 2B can be passed adjacent to photoconductive layer 2 to impart magnetic transitions 6 within magnetizable layer 1. Therefore, in the second embodiment magnetization and exposure can be provided from the same side of the electrophotographic magnetic imaging member.

Conductive, magnetizable layer 1 comprises magnetizable material 3 dispersed in a binder. Any magnetizable material can be employed. Typical suitable magnetizable materials include Cobaloy, chromium dioxide, $\gamma$-$fe_{2\ 3}$, barium ferrite, lead ferrite, strontium ferrite, samarium cobalt, alloys of aluminium-nickel-cobalt, cobalt ferrite, magetite manganese arsenide, and mixtures thereof. Other magnetic materials can be employed. Preferably, the magnetic material employed in conductive magnetizable layer 3 has a relatively low Curie point such as, for example, chromium dioxide, in order to conserve the amount of energy required for thermoremanent erasure of the magnetic material by the visible electromagnetic radiation. Further, the magnetic material 3 is present in conductive, magnetizable layer 1 in an amount sufficient to render magnetizable layer 1 at least sufficiently conductive to discharge photoconductive layer 2 upon exposure of layer 2 to actinic electromagnetic radiation.

The binder material in conductive, magnetizable layer 1 can comprise any binder material. The function of the binder material is to hold or cement together the particles of magnetizable material 3. The particles of magnetizable material 3 are present in magnetizable layer 1 in an amount sufficient to render layer 1 conductive. Thus, the minimum amount of particle 3 loading in layer 1 is the amount required to render the layer sufficiently conductive to allow for electrophotographic discharge of photoconductive layer 2. The maximum loading of particles 3 in layer 1 can be as high as saturation, typically occurring when particles 3 occupy 70% of the volume of layer 1 or constitute about 90% of the weight of layer 1. Typical suitable binders include polystyrene resins, silicone resins, acrylic and methacrylic polymers and copolymers and mixtures thereof.

Typical binder materials include Staybelite Ester 10, a partially hydrogenated rosin ester, Foral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyreneolefin copolymer from Velsicol Chemical Corp.; hydrogenated Piccopale 100, Piccopale H-2, highly branched polyolefins, Piccotex 100, a styrene-vinyl toluene copolymer, Piccolastic A-75, 100 and 125, all polystyrenes, Piccodienes 2215, a polystyrene-olefin copolymer, all from Pennsylvania Industrial Chemical Corp.; Araldite 6060 and 6071, epoxy resins from Ciba; R5061A, a phenylmethyl silicone resin from Dow Corning, Epon 1001, a bisphenol A-epichlohydrin epoxy resin from Shell Chemical Corp.; and PS-2, PS-3, both polystyrenes, and ET-693, a phenolformaldehyde resin, from Dow Chemical; customs synthesized copolymers of styrene and hexylmethacrylate, a custom synthesized [5] polydiphenylsiloxane; a custom synthesized polyadipate, acrylic resins available under the trademark Lucite from the E.I. DuPont de Nemours & Co.; thermoplastic resins available under the trademark Pliolite from the Goodyear Tire and Rubber Co.; a chlorinated hydrocarbon available under the trademark Aroclor from Monsanto Chemical Co.; thermoplastic polyvinyl resins available under the trademark Vinylite from Union Carbide Co., other thermoplastic disclosed in Gunther et al U.S. Pat. No. 3,196,011; Ethocel and ethyl cellulose material from Dow Chemical Co., polyeylene adipate, polyhexamethylene sebacate, polyvinyl alcohol, polyvinylbenzyltrimethyl amonium chloride, and polyvinylcarbazole.

It will be understood that composite magnetic recording mediums made in accordance with the present invention are preferably self-supporting. That is, layers 2 and 1 are sufficiently rigid to avoid the need for a supporting substrate. However, the present invention includes embodiments wherein the nature of the materials employed in layers 2 and 1 require delicate handling.

Further, photoconductive layer 2 can comprise not only an organic photoconductor but can include a relatively thin overlayer of inorganic photoconductor residing on the surface of an organic photoconductor. For example, where it is desired to have the phenomenon of photoinjection of charge during the creation of an electrostatic latent image, a thin layer of selenium can be deposited by conventional deposition techniques, such as, for example, vacuum evaporation, blade coating, etc., upon an organic layer such as, for example, the previously mentioned mixture of triphenylamine and Lexan. The selenium in this particular combination provides photoinjection of charge whereas the triphenylamine and Lexan impart rigidity to the composite member, absorbs very little of the visible electromagnetic radiation used for thermoremanent erasure of the magnetizable layer 1, and imparts speed to electrophotographic imaging of photoconductive layer 2.

Figure 2A:
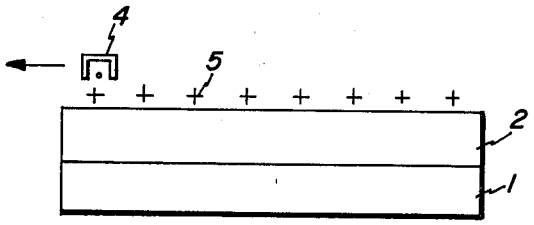
FIGS. 2A-2D are schematic illustrations of the simplified imaging method provided by utilizing the composite magnetic recording medium of the present invention.
Figure 2B:
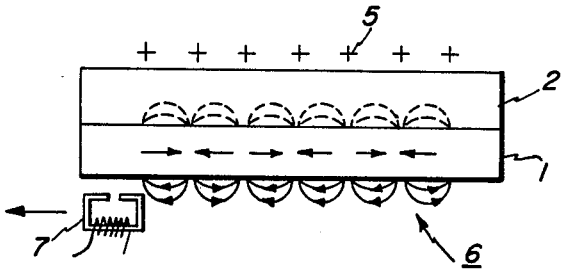

In use, the composite magnetic recording medium is provided with charge at the surface of photoconductive layer 2 by corotron 4 in accordance with well known xerographic charging techniques. This is schematically illustrated in FIG. 2A. Before, during or after the step of charging photoconductive layer 2, or, at any time during the imaging method and prior to thermoremanent exposure of the composite member to visible electromagnetic radiation for the purpose of thermoremanent erasure as depicted in FIG. 2D, the conductive, magnetizable layer 1 is magnetically recorded by recording head 7 and thereby provided with magnetic transitions 6 and their accompanying magnetic fields shown as semicircular arrows and dotted semicircles. This is schematically illustrated in FIG. 2B. Any magnetic recording technique can be utilized and are well known in the art of magnetic recording.

Figure 2C:
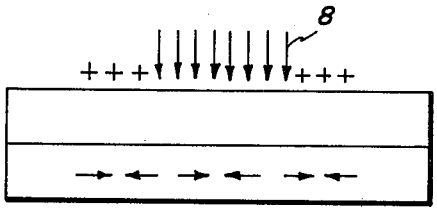
Figure 2D:
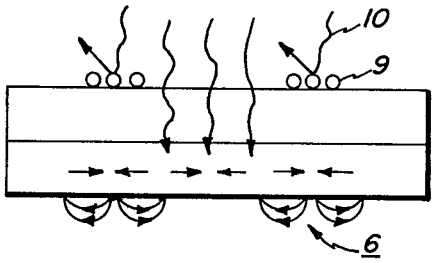

As schematically illustrated in FIG. 2C, the charged photoconductive layer 2 is imagewise exposed to actinic electromagnetic radiation 8. Actinic electromagnetic radiation is radiation which is within the absorption band of the photoconductive material in photoconductive layer 2 and which causes the movement of charge from the surface of photoconductive layer 2 into photoconductive layer 2 as is well known in the xerographic imaging art. The xerographic steps of charging and imagewise exposure of the photoconductive layer 2 to actinic electromagnetic radiation results in the creation of an electrostatic latent image.

As schematically illustrated in FIG. 2D, the electrostatic latent image is developed with xerographic developer and thereby provided with electroscopic toner 9 in imagewise configuration corresponding to the electrostatic latent image. Electroscopic toner 9 can be any toner which absorbs or reflects visible electromagnetic radiation 10 during the thermoremanent erasure step. Typical suitable electroscopic toners which absorb radiation are the classically black or dark colored electroscopic toners utilized in xerographic imaging either in black and white or in color. These toners typically comprise resins pigmented with a relatively dark pigment. A suitable reflective electroscopic toner is similarly provided by pigmenting resins with a relatively light colored pigment such as, for example, titanium dioxide.

The exposure of the composite magnetic recording medium to visible electromagnetic radiation 10 is carried out with an intensity of radiation and duration of exposure sufficient to reach the Curie point of the magnetizable material 3 heated to its Curie point are thereby erased due to the phenomenon of thermoremanence. This phenomenon involves the disappearance of ferromagnetism into paramagnetism as a material's temperature is raised to its Curie point, $T_c$. Below $T_c$ there is another temperature, $T_b$, the blocking temperature, which marks the onset of super-paramagnetism. Erasure of magnetic transitions in layer 1 relies upon the step of cooling the magnetic media from a temperature greater than or equal to $T_c$ down to a temperature less than or equal to $T_b$, in the absence of a magnetizing field. Any means of heating with visible electromagnetic radiation can be employed to heat magnetizable material 3 to its Curie point. Gaseous discharge flash heating by Xenon, argon, hydrogen, sodium, etc., flash lamps are preferred in order to avoid any concern over possible heat deformation of heat softenable constituents in the composite member. For example, when chromium dioxide is utilized as magnetizable material 3, a xenon gaseous discharge flash energy of about $2.6\times10^6$ ergs/cm$^2$ can be employed to reach the chromium dioxide Curie point of about 130° C. without adverse deformation.

EXAMPLE I

A composite magnetic recording medium is provided in accordance with the present invention by first combining one part by weight triphenylamine to two parts by weight Lexan and forming a solution of the mixture in methylethylketone wherein the solution comprises about 80% by volume solvent and about 20% by volume solute. This solution is coated upon a sheet of tetrafluorethylene fluorocarbon resin available under the trademark Teflon from E. I. DuPont de Nemours & Co. The coating is formed by utilization of a Bird Coater Bar to a thickness of about 10 microns.

Next, a dispersion of chromium dioxide magnetizable particles is dispersed in polyvinyl carbazole by adding about 0.7 grams of chromium dioxide particles and about 0.3 grams of polyvinylcarbazole to about 2.7 grams of benzene. This dispersion is coated upon the dried previously formed triphenylamine and Lexan layer to a thickness of about 10 microns.

After air drying of the chromium dioxide and polyvinyl carbazole layer, both layers are bound to each other and are pulled as a unit from the Teflon sheet. The unit is placed in a vacuum evaporation chamber and a layer of selenium is vacuum evaporated upon the surface of the triphenylamine and Lexan layer to a thickness of about 0.1 micron.

EXAMPLE II

Example I is followed to provide the composite magnetic recording medium of the present invention. The selenium coated side of the member is electrostatically charged and exposed to imagewise configured actinic radiation to form an electrostatic latent image. This image is developed with electroscopic toner comprising titanium dioxide pigment particles. The selenium coated side of the member is exposed to radiation from a Xenon gaseous discharge lamp, at an intensity of about $2.6\times10^6$ ergs/cm$^2$ for a duration of about 150 microseconds. The chromium dioxide-polyvinylcarbazole layer is developed with magnetic toner comprising magnetizable particles dispersed in a resin. The magnetic toner adheres to the chromium dioxide-polyvinylcarbazole layer in imagewise configuration corresponding to the configuration of the developed electrostatic latent image.

EXAMPLE III

Example II is followed except that in following the procedure of Example I, the step of vacuum evaporating selenium upon the triphenylamine and Lexan layer is omitted. A developed magnetic image is obtained.

EXAMPLE IV

Example II is followed except that in following the procedure of Example I, the formation of the triphenylamine and Lexan layer is omitted; rather, the selenium coating is vacuum evaporated directly upon the chromium dioxide-polyvinylcarbazole layer. The developed magnetic image is obtained.

Other modifications and ramifications of the present invention will occur to those skilled in the art upon a reading of the present disclosure. These are intended to be included within the scope of this invention.

Advantages provided by the practice of the present invention include disposing of the need to fuse toner to the photoconductor or transfer toner from the photoconductor in order to make the magnetic latent image; disposing of the need for any separate interpositive or transparency step in making the magnetic latent image; the reusability of the photoconductive layer, magnetic layer and electroscopic toner since fusing of either the electroscopic toner or magnetic toner is not required and, for the same reasons, corrections can be made to the xerographic developed image before creation of the magnetic latent image.

In preferred embodiments of the present invention which are sufficiently self-supporting to obviate the need for a supporting substrate in between layers 1 and 2, these layers are preferably cast in a manner which maintains interfacial integrity between two layers. For example, the solvents from which each layer is cast is chosen to minimize the re-dissolution of the previously cast layer. Also, it will be appreciated that the order of casting is immaterial. That is, layer 2 can be cast upon layer 1 or layer 1 can be cast upon layer 2.

What is claimed is:

1. A thermomagnetic recording method comprising charging electrostatically the surface of a photoconductive layer of a recording member including the photoconductive layer and a magnetizable layer, said photoconductive layer being transmissive of electromagnetic radiation of at least some wavelength within the visible spectrum extending from about 2900 to about 38,000 angstroms and being photoelectrically responsive to actinic radiation of some wavelength within the visible spectrum, said magnetizable layer being absorbtive of the radiation transmitted through the photoconductive layer, exposing the charged surface of the recording member to a pattern of actinic radiation to create a corresponding pattern with electrostatic charge on the surface, developing the electrostatic charge pattern by depositing a toner material on the photoconductive surface that either reflects or absorbs radiation transmitted by the photoconductive layer, recording the magnetizable layer with a uniform pattern of magnetic transitions, and exposing, from the photoconductive layer side, the recording member to radiation transmitted by the photoconductive layer to heat the magnetizable layer above its Curie point temperature in regions complementary to the toner material to record a latent magnetic image in the magnetizable layer corresponding to the pattern of the toner material.

2. The method of claim 1 further including developing the latent magnetic image by depositing magnetic toner material on the recording member side opposite the photoconductive layer.

3. The method of claim 1 wherein the recording member includes only the two mentioned layers and the magnetizable layer is electrically conductive to a degree to permit the formation of the pattern of electrostatic charge during the first exposure step.

4. The method of claim 1 wherein the magnetizable layer includes chromium dioxide.

5. The method of claim 1 wherein the photoconductive layer includes selenium to a thickness of about less than 1 micron.

6. The method of claim 1 wherein the recording layer and photoconductive layer are about the same thickness of about 10 microns.

7. The method of claim 1 wherein the magnetizable layer includes polyvinylcarbazole binder material.

8. The method of claim 1 wherein the photoconductive layer includes triphenylamine and a polycarbonate resin.

9. The method of claim 1 wherein the photoconductive layer comprises a coating of selenium on a layer including triphenylamine and a resin.

* * * * *